US005736697A

United States Patent [19]

Fuller et al.

[11] Patent Number: 5,736,697

[45] Date of Patent: Apr. 7, 1998

[54] MECHANICALLY ACTUATED INDICATOR FOR A PUSHBUTTON SWITCH

[75] Inventors: Kennett R. Fuller; Lyle J. Bush, both of Morrison; Sean A. Hicks, Lyndon, all of Ill.

[73] Assignee: General Electric Company, Fort Wayne, Ind.

[21] Appl. No.: 748,072

[22] Filed: Nov. 12, 1996

Related U.S. Application Data

[63] Continuation of Ser. No. 382,271, Feb. 1, 1995, abandoned.

[51] Int. Cl.[6] ..... H01H 9/16

[52] U.S. Cl. ..... 200/5 R; 200/308

[58] Field of Search ..... 200/5 R, 5 A, 200/16 R, 17 R, 18, 512–517, 308–317, 341

[56] References Cited

U.S. PATENT DOCUMENTS

| | | | |
|---|---|---|---|
| 2,210,539 | 2/1940 | Iwanowicz | 200/159 |
| 3,358,099 | 12/1967 | De Bellomayre | 200/113 |
| 3,576,175 | 4/1971 | Gammill | 116/124 |
| 3,588,398 | 6/1971 | Siviy | 200/50 |
| 3,855,959 | 12/1974 | Hinze | 116/124 R |
| 3,855,961 | 12/1974 | Schadow | 116/124 R |
| 3,867,596 | 2/1975 | Schadow | 200/153 J |
| 4,023,003 | 5/1977 | Arthur et al. | 200/308 |
| 4,044,213 | 8/1977 | Kinney | 200/308 |
| 4,052,954 | 10/1977 | Roy | 116/124 L |
| 4,128,750 | 12/1978 | Castonguay et al. | 200/308 |
| 4,129,766 | 12/1978 | Miyata et al. | 200/308 |
| 4,223,193 | 9/1980 | Iwasaki et al. | 200/308 |
| 4,234,773 | 11/1980 | Nakatani et al. | 200/308 |
| 4,287,401 | 9/1981 | Rohrbach | 200/308 |
| 4,354,076 | 10/1982 | Lutzenberger | 200/308 |
| 4,362,910 | 12/1982 | Boebel et al. | 200/5 EA |
| 4,420,664 | 12/1983 | Takahashi | 200/308 |
| 4,635,013 | 1/1987 | Lemarquand et al. | 335/20 |
| 4,877,931 | 10/1989 | Kawase et al. | 200/308 |
| 4,954,675 | 9/1990 | Iwata et al. | 200/317 |
| 5,219,416 | 6/1993 | Rochard et al. | 200/308 |

FOREIGN PATENT DOCUMENTS

| | | | |
|---|---|---|---|
| 2632768A | 12/1989 | France | H01H 9/18 |
| S1043478 | 11/1958 | Germany | H01H 9/18 |
| 1175578 | 12/1969 | United Kingdom | H01H 9/16 |
| 1436602 | 5/1976 | United Kingdom | H01H 9/16 |

*Primary Examiner*—Cassandra C. Spyrou
*Assistant Examiner*—Michael A. Friedhofer
*Attorney, Agent, or Firm*—Wayne O. Traynham

[57] ABSTRACT

A switch device for controlling at least one electrical circuit comprises a pushbutton movable between a pair of preselected positions for effecting the operation of the switch device, an indicator movable in the switch device toward a viewable position for effecting a visual indication of one of the preselected positions of the pushbutton, and a resilient cantilever associated with the pushbutton and the indicator operable generally for moving the indicator into its viewable position upon the movement of the pushbutton to its one preselected position. The pushbutton includes apparatus for driving the resilient cantilever to effect its operation in response to the movement of the pushbutton to its one preselected position.

14 Claims, 2 Drawing Sheets

MECHANICALLY ACTUATED INDICATOR FOR A PUSHBUTTON SWITCH

This application is a continuation of application Ser. No. 08/382,271 filed Feb. 1, 1995 now abandoned.

BACKGROUND OF THE INVENTION

The present invention relates to pushbutton switches for electrical circuits and, more particularly, to a mechanical indicator for attachment to such pushbutton switches for visually indicating the status of a switch.

Manually actuated pushbutton switches are used in numerous applications for controlling the application of electrical power to numerous devices. Such pushbutton switches may be used singly or in banks of multiple switches. Some of these switches have been designed to have a low travel range between activation and deactivation of the switch. For example, it is not uncommon for the pushbutton on a conventional switch to have a travel range of about 1/16 inch between an activated and non-activated position. Furthermore, it is common for such switches to be placed in a panel where they may be mounted substantially flush with the surface of the panel and covered by a protective or decorative membrane. In such instances, it is difficult if not impossible to determine the state of a pushbutton switch by mere observation of the switch. Accordingly, it is common practice to associate some form of indication device with each such switch to thereby indicate to an observer the status of the switch. The primary form of indication which has been adapted for flush mount switches has been the use of an electrical circuit to illuminate a lamp to show the status of the switch. In the case of a bank of multiple switches, it is necessary to either provide multiple indicators to show the position of each switch or to provide some electrical circuit associated with the bank of switches to indicate which one of the switches has been activated. In general, such added circuitry has been expensive and complex and required the use of additional electrical contacts to activate a visual indicator.

SUMMARY OF THE INVENTION

Among the several objects of the present invention may be noted the provision of an improved indication device for a manually operated pushbutton switch which overcomes the above and other disadvantages of the prior art; the provision of an indication device for a manually actuated pushbutton switch which uses mechanical components associated with the switch to eliminate additional electrical circuitry; and the provision of an improved mechanical indicator for a bank of pushbutton switches which provides a visual indication of the status of each of the switches by mechanical sensing of switch position.

The above and other objects of the present invention are achieved in one form in a pushbutton switch having low travel motion by modifying a pushrod attached to the pushbutton actuator on the switch to incorporate a lance extending outward of the pushrod which can be used to sense the position of the pushrod. A housing is attached to the switch encompassing the pushbutton and having a low mass spring lever mounted across the base of the housing extending transverse to the direction of the pushbutton pushrod. The spring lever passes adjacent to the pushrod so as to engage the lance when the pushbutton is in at least one position. In the illustrative embodiment, the spring lever is set to engage the lance when the pushbutton is in its up or inactivated position. The spring lever is cantilevered from one side of the housing to an opposite end of the lever fitting into a pivotable member mounted in the housing. When a lever is moved up or downward by the actuation of the pushbutton, the pivotable indicator is pivoted about its axis by movement of the spring lever. The indicator has one end positioned to pivot into a view port when the pushbutton switch is in an actuated position. Accordingly, when the pushbutton switch is activated, the indicator is visible through the view port to thereby provide a visual indication of the status of the pushbutton switch.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
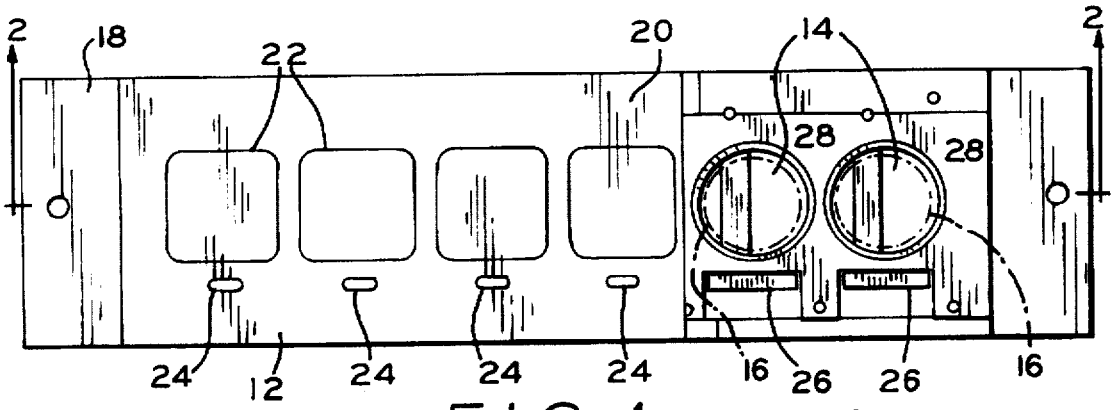
FIG. 1 is a top plan view of a bank of pushbutton switches incorporating the mechanical indicator of the present invention.

Referring now to FIG. 1, there is shown a top plan view of a pushbutton switch bank 10 in which the pushbutton switches are overlayed by a housing 12 having a plurality of openings such as those indicated at 14 for passing the pushbuttons on the pushbutton switches mounted in the bank 10. A pair of the pushbuttons are shown at 16 by phantom lines within the apertures 14. The housing 12 is attached to a mounting plate 18 which plate is attached to the pushbutton switch bank assembly. In normal operation, the top of the housing 12 is covered by a membrane 20 which membrane has a plurality of flexible portions 22 overlaying each of the apertures 14 in which a pushbutton 16 is located. For purposes of illustration, the membrane is removed from the right hand two apertures 14 so that the underlying housing structure can be seen in the top plan view. It will be noted also that the membrane 20 has a plurality of view ports 24 adjacent each of the pushbutton switch locations. The view ports 24, which may be transparent segments in the membrane 20, allow for visual observation of the status of each of the pushbutton switches, i.e., whether the switch is in an actuated or an unactuated position. The actuated position is indicated by a pivotable indicator 26, two of which are visible at the righthand end of FIG. 1. The indicators are provided with an upper surface that is reflective or colored so that when the indicator surface is beneath a view port 24, the surface is visible in the view port. When the indicator is in another position, the view port appears dark as is shown in the view ports 24 at the lefthand end of FIG. 1. A pair of flexible lever arms 28 which control the position of the indicators 26 is shown in the uncovered apertures 14.

Figure 2:
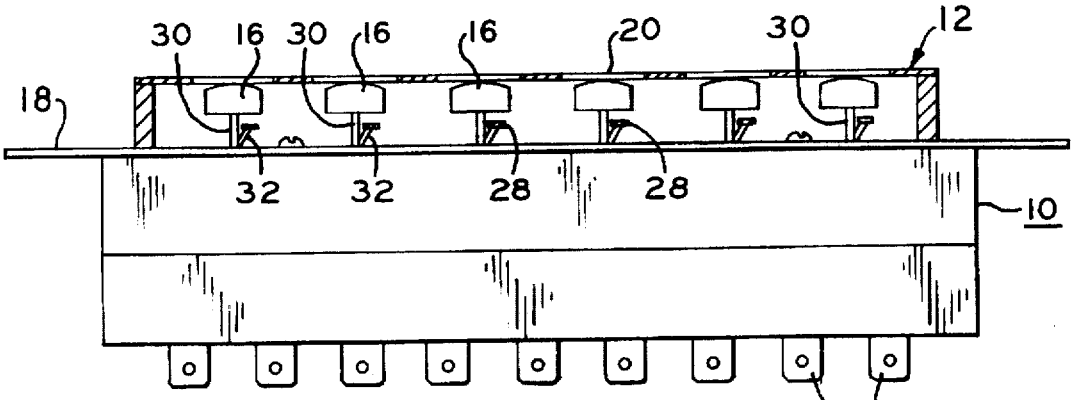
FIG. 2 is a partial cross-sectional view of the mechanical indicator of FIG. 1 attached to a bank of pushbutton switches.

Turning now to FIG. 2, which shows a partial cross-sectional view of the housing 12 mounted on top of the switch assembly 10, it can be seen that each pushbutton 16 has a top surface which lies just under the covering membrane 20. Each pushbutton 16 is also associated with a pushrod 30 which extends from the pushbutton down to the electrical and mechanical contact mechanism of the switch assembly 10. The switch assembly 10 is a conventional pushbutton switch bank assembly having a plurality of electrical contacts 32 which are connected in various combinations by actuation of the pushbuttons 16 to depress the pushrods 30 and actuate the mechanical mechanism of the switches within the switch bank assembly 10. The switch bank assembly 10 is a commercially available switch bank and may be one of any of the known types of pushbutton switch assemblies.

In the present invention, each of the pushrods 30 is modified by providing a lance 32 extending from the side of the pushrods 30. Each of the lances 32 may be formed by using a die to partially punch through the pushrod 30. As will be appreciated, the conventional pushrod for these pushbutton switches is a metal strip thereby facilitating punching of a section from within the strip. It will also be noted that each of the lances 32 contacts one of the lever arms 28 when the pushbutton switches are in their up positions. This arrangement is established by positioning the lever arms 28 and the lances 32 to contact a bottom surface of the lever arm. Clearly, it would be possible to change the direction in which the lever arms and lances contact one another by reversing the orientation of the lances 32 to contact the top of the lever arm. As will be appreciated from a further description in conjunction with FIG. 4, it will be seen that the optimal position is attained by having the lances 32 contact a bottom surface of the lever arm 28 rather than pressing the lever arm 28 downward.

Figure 3:
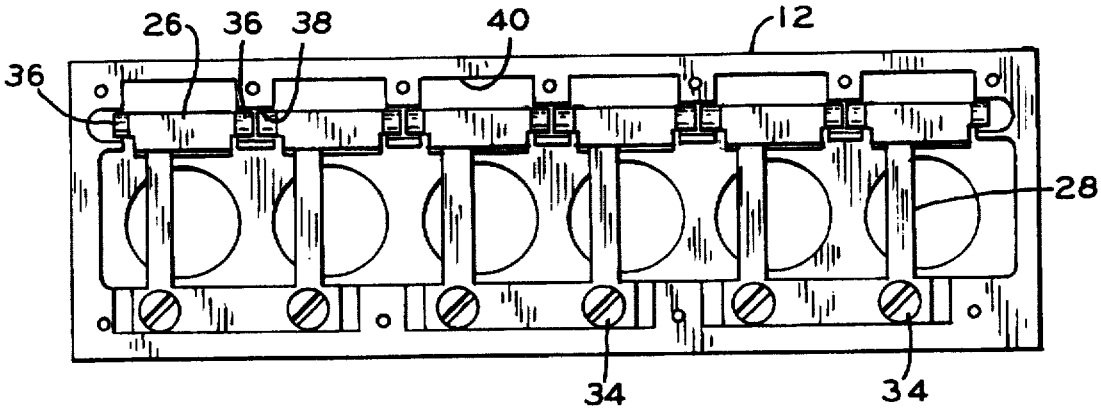
FIG. 3 is a bottom plan view of the mechanical indicator housing of FIG. 1.

Referring now to FIG. 3, there is shown a bottom plan view of a housing assembly 12 of the present invention in which the plurality of lever arms 28 can be seen as comprising cantilever devices attached to one side of the housing 12 and extending across the housing in a direction transverse to the direction of the pushrods 30. In one form, the lever arms 28 are formed in pairs and are attached to the housing 12 by means of screws 34. Alternately, other suitable connection means such as by ultrasonic welding, riveting, adhesive bonding or other means well known in the art may be used. At the opposite end of the lever arms 28, there is provided a plurality of indicators 26 that are pivotably mounted within the housing 12. Each indicator 26 has a pair of oppositely directed stub axles 36 which reside within grooves 38 formed in a lower surface of the housing 12. Each indicator 26 fits within a slot 40 designed to fit about the indicator 26 and enable it to pivot in response to movement of the lever arms 28.

Figure 5:
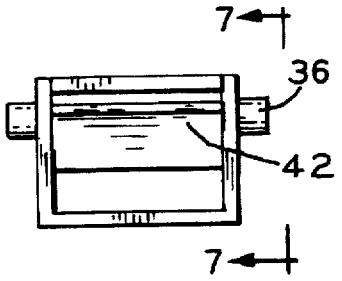
FIGS. 5, 6 and 7 are front, rear and cross-sectional views of the indication device used in the mechanical indicator of FIG. 1.
Figure 6:
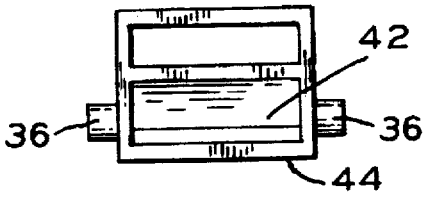
Figure 7:
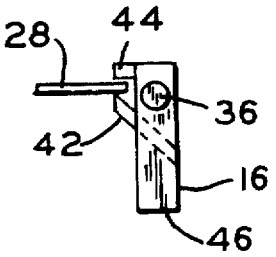

For a better understanding of the indicators 26, reference is now made to FIGS. 5, 6 and 7 which show front, rear and side views of the indicators 26. From examination of these figures, it can be seen that the indicators 26 each comprise a rectangular framework having a pair of stub axles 36 extending from opposite sides and a cross piece 42 extending across the indicator in the direction of the stub axles 36. The cross piece 42 is angularly inclined within the framework of the indicators 26 as best seen in FIG. 7. It will also be noticed that the cross piece 42 is wider than the width of the indicators 26 and extends outward of the framework as does the end member 44 forming the bottom of the indicator frame. In FIG. 7, the lever arm 28 is shown entering the space between the bottom member 44 and the cross piece 42. As can be appreciated, as the lever arm 28 is moved in a direction which would be downward in FIG. 7, the indicator 26 will pivot about the axis defined by the stub axles 36 causing the opposite end 46 of the indicator 26 to move in a pivotable direction. Due to the relative length of the lever arm between the axle 36 and the contact point of lever 28 with cross piece 42 as compared to the distance between end 46 and axle 36, a slight movement of lever arm 28 will result in a large movement of end 46.

Figure 4:
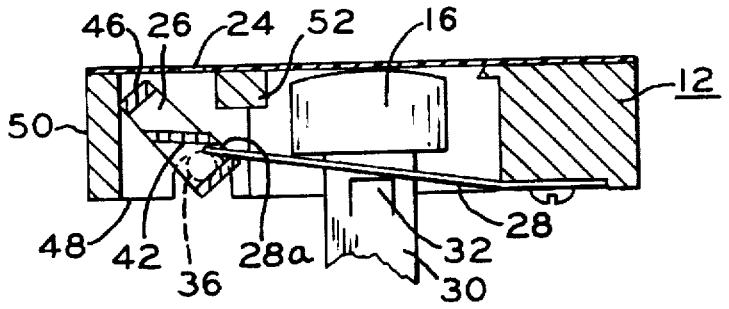
FIG. 4 is a cross-sectional view showing the operation of the mechanical indicator of FIG. 1.

Referring now to FIG. 4, there is shown an enlarged cross-sectional view through the housing 12 illustrating how the indicator 26 is pivoted about the axle 36 by means of movement of the lever arm 28. In FIG. 4, the pushbutton 16 is in an up or inactuated position and has caused the lever arm 28 to be raised by contact with the lance 32. As the lever arm 28 is raised, its end 28A in contact with cross piece 42 causes the indicator 26 to rotate counter clockwise so that the upper surface of end piece 46 is tilted away from the view port 24. As will be apparent, if the pushbutton 16 is depressed so that the lance 32 drops below the bottom surface 48 of the housing 12, the lever arm 28 will rotate back to a flat position substantially aligned with the bottom 48 causing indicator 26 to pivot in a clockwise direction. As indicator 26 pivots clockwise, the upper surface of end section 46 will rotate beneath view port 24 and be visible in the manner described with reference to FIG. 1. The lever arm 28 returns to its normal horizontal position due to the elastic memory of the metal material of the lever arm. Typically, the arm would be formed of phosphorous bronze or other suitable resilient material. It will also be seen that the indicator 26 is stopped in its counter clockwise rotation by abutment against the sidewall 50 of the outer housing 12 and in its clockwise rotation by the intermediate short partition 52 within housing 12.

Figure 8:
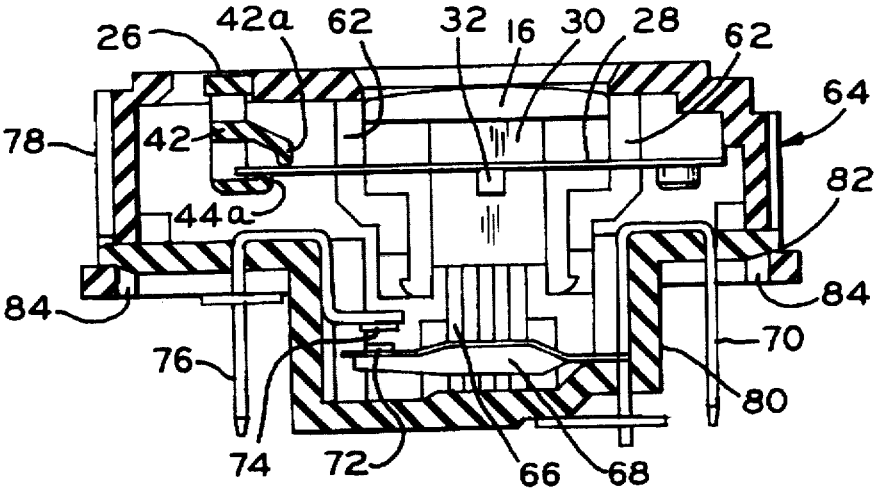
FIG. 8 is a cross-sectional view of a switch assembly in accordance with the teaching of the present invention.

Turning now to FIG. 8, there is shown a further embodiment of a low-travel pushbutton switch incorporating the inventive position indicator in an integrated switch assembly. The switch 60 of FIG. 8 includes an indicator 26 operated by a cantilever arm 28 which is forced upward by engagement with lance 32 on pushbutton shaft or pushrod 30. Pushbutton shaft 30 extends from pushbutton 16. In the embodiment of FIG. 4, pushbutton 16 is described as a plastic cap on a metal pushrod 30. In the embodiment of FIG. 8, the pushbutton 16 and shaft 30 are conjointly molded from plastic using injection molding or other well known techniques. The pushbutton 16 and shaft 30 are held in alignment by side elements 62 integrally molded into switch housing 64. It will also be noted that the structure of indicator 26 and in particular the shape of cross-piece 42 is modified in this embodiment. The cross-piece 42 and the bottom member 44 are formed with enlarged flanges **42*a* and 44*a* which contact the lever arm 28 and provide more leverage for pivoting indicator 26**.

The contact structure of switch 60 may be substantially as shown and described in U.S. Pat. No. 5,315,076, particularly with respect to slide members 66 and contact member 68. One end of contact member 68 is connected to terminal 70 while another end has a contact tip 72 adapted to mate with a contact tip 74 on a second terminal 76. For a discussion of the operation of contact member 68 in response to slide members 66, reference is made to U.S. Pat. No. 5,315,076 the disclosure of which is hereby incorporated by reference.

In a preferred form, switch 60 includes an upper housing portion 78 and a lower housing portion 80. Housing portion 78 holds the pushbutton 16, shaft 30 and indication mechanism. The lower edge 82 of portion 78 incorporates snap fittings 84 which snap into mating slots (not shown) in lower housing portion 80. Portion 80 holds the switch components such as slide members 66 and contact 68 as well as terminals 70 and 76. In this preferred embodiment, the switch components are integrated with the position indicator resulting in a more compact structure at a lower switch cost.

While the invention has been described in what is presently considered to be a preferred embodiment, various modifications and arrangements may become apparent to those skilled in the art. It is intended therefore that the invention not be limited to these specific disclosed embodiment but be interpreted within the full spirit and scope of the appended claims.

What is claimed is:

1. A mechanical indicator for indicating the status of a pushbutton switch, the pushbutton switch having a switching mechanism, a pushbutton and a shaft extending from said pushbutton to said mechanism, the indicator comprising:

a housing attachable to said switch and having a cavity portion thereof encompassing at least a portion of said pushbutton and said shaft, said pushbutton being actuatable from one side of said housing and said shaft extending from said pushbutton out of said cavity portion and into said switch;

a lever arm having first and second ends and extending across said cavity portion of said housing, said first end being attached to said housing at a first side thereof;

a pivotable member coupled to a second side of said housing opposite said first side, said pivotable member engaging said second end of said lever arm whereby flexure of said second end of said lever arm affects pivotable movement of said pivotable member between first and second positions;

means on said shaft for engaging said lever arm for affecting flexure thereof in response to actuation of said pushbutton switch; and a view port in said housing aligned with said pivotable member such that said pivotable member is visible in said view port when said pivotable member is in one of said first and second positions.

2. The indicator of claim 1 wherein said means on said shaft for engaging said lever arm comprises a lance formed by punching a segment of said shaft outward thereof.

3. A mechanical indicator for indicating the status of a pushbutton switch comprising:

a pushbutton switch having a switching mechanism, a pushbutton and a shaft extending from said pushbutton to said mechanism;

a housing attached to said switch and having a cavity portion thereof encompassing at least a portion of said pushbutton and said shaft;

a lever arm having first and second ends and extending across said cavity portion of said housing, said first end being attached to said housing at a first side thereof;

a pivotable member coupled to a second side of said housing opposite said first side, said pivotable member engaging said second end of said lever arm whereby flexure of said second end of said lever arm affects pivotable movement of said pivotable member between first and second positions;

means on said shaft for engaging said lever arm for effecting flexure thereof in response to actuation of said pushbutton switch;

a view port in said housing aligned with said pivotable member such that said pivotable member is visible in said view port when said pivotable member is in one of said first and second positions; and said pivotable member comprising:

a rectangular structure having a pair of opposite side elements connected together by a top and a bottom element;

a pair of stub shafts each extending generally perpendicularly outward from said respective ones of said opposite side elements, said stub shafts being adapted for supporting said pivotable member for pivotable movement;

a cross-piece extending between said opposite side elements adjacent said bottom element, said cross-piece and said bottom element forming a pair of closely spaced reaction surfaces for reacting against said second end of said lever arm for affecting pivotable movement of said pivotable member; and a generally planar surface on an outer face of said top element for viewing a position of said pivotable member.

4. The indicator of claim 3 wherein said housing includes an aperture passing therethrough for receiving said pivotable member and a pair of slots on opposing sides of said aperture for receiving said stub shafts.

5. The indicator of claim 4 wherein said cross-piece has an upper reaction surface angularly inclined with respect to said generally planar surface of said top element.

6. The indicator of claim 5 and including a plurality of switches arranged in a generally abutting, linear pattern, said housing extending over said switches and including a plurality of openings for accessing each pushbutton on each of said switches and a corresponding plurality of pivotable members operably associated with each of said pushbuttons for indicating a status thereof.

7. The indicator of claim 6 and including a membrane-like cover overlaying said housing, said cover having a plurality of view ports for viewing each of the pivotable members in at least one position thereof.

8. A switch device comprising a plurality of mechanically coupled individual switching units in a common casing, and each of the switching units comprising:

pushbutton means movable between a pair of preselected positions for effecting operation of the switch device;

means movable in the switch device between a pair of positions for effecting a visual indication of said preselected positions of said pushbutton means;

resilient means associated with said pushbutton means and said visual indication effecting means and operable generally for moving said visual indication effective means between said pair of positions upon the movement of said pushbutton means between said pair of preselected positions;

said pushbutton means including means for driving said resilient means into at least one position to effect said operation in response to each movement of said pushbutton means between said pair of preselected positions; and said resilient means comprising a leaf spring having one end fixed to a first side of said casing and extending thereacross into engagement with said moveable means on an opposite side of said casing, said pushbutton means being generally centrally located between said first side and said opposite side of said casing, said leaf spring being arranged to exert a spring force in a selected direction, said driving means comprising means extending generally transverse to a direction of extension of said leaf spring and engaging said leaf spring from one surface thereof wherein said leaf spring urges said pushbutton means in said selected direction.

9. The switch device of claim 8 wherein each said leaf spring extends as one of a pair of leaf springs from a common transverse member.

10. The switch device of claim 9 wherein each of said pushbutton means comprises:

an outer generally flat plate;

a push rod extending normal to said flat plate from about a central section thereof;

an arm extending from said push rod for engaging a corresponding one of said leaf springs, said arm functioning as said driving means; and a pair of spaced guide means extending into said casing for receiving said push rod for enabling said movement of said pushbutton means.

11. The switch device of claim 10 and including means on said push rod for retaining said push rod in said guide means.

12. The switch device of claim 10 and including a plurality of generally elongate sliders movably mounted within the housing, each of said sliders having a first edge and a first plurality of cam surfaces on said first edge for interacting with paired electrical contacts of the switch device to selectively open and close the contacts as the slider moves between first and second positions within the housing, and each of said sliders having a second edge and a second plurality of cam surfaces on said second edge for interacting with a first end of a respective one of a plurality of push rods as said push rods are axially moved, said first ends of the push rods interacting with at least one of the cam surfaces on said second edges of the sliders to cause a respective one of the sliders to move.

13. The switch device of claim 8 wherein said moveable means comprises:

a top element having a generally planar viewing surface;

a first and a second element extending transversely from said top element;

a first stub axle extending from said first element;

a box-like structure extending from said second element and having a pair of generally parallel reaction surfaces for engaging an end of said resilient means;

another stub axle extending from said box-like structure in a direction opposite said first stub axle but axially aligned therewith; and said reaction surfaces being offset from an axis of said first and another stub axles whereby movement of said resilient means affects a rotation of said moveable means for moving said viewing surface between said pair of positions.

14. The switch device of claim 13 and including means in said casing for supporting said moveable means by said first and another stub axles.

* * * * *